United States Patent [19]

Eudier et al.

[11] Patent Number: 4,537,167

[45] Date of Patent: Aug. 27, 1985

[54] ENGINE CYLINDER LINERS BASED ON ALUMINUM ALLOYS AND INTERMETALLIC COMPOUNDS, AND METHODS OF OBTAINING THEM

[75] Inventors: Michel Eudier, Paris; Noël Huret, Noisy le Grand; Jean Meunier, Crenoble, all of France

[73] Assignees: Cegedur Societe de Transformation de L'Aluminim Pechiney; Alliages Frittes METAFRAM, both of Paris, France

[21] Appl. No.: 557,947

[22] Filed: Dec. 5, 1983

[30] Foreign Application Priority Data

Dec. 9, 1982 [FR] France ..... 82 20983

[51] Int. Cl.[3] ..... F02F 1/18

[52] U.S. Cl. ..... 123/193 C; 29/156.4 WL; 419/67; 419/68; 75/231; 75/249; 75/255; 148/11.5 P; 428/546; 428/547

[58] Field of Search ..... 75/231, 249, 255; 420/528, 542, 546, 548, 533, 534; 419/67, 68; 428/546, 547; 29/156.4 WL; 123/193 C; 148/11.5 P, 11.5 A

[56] References Cited

U.S. PATENT DOCUMENTS

| | | | |
|---|---|---|---|
| 3,690,961 | 9/1972 | Berghezan | 148/11.5 P |
| 4,068,645 | 1/1978 | Jenkinson | 123/193 C |
| 4,155,756 | 5/1979 | Perot et al. | 75/231 |
| 4,347,076 | 8/1982 | Ray et al. | 75/249 |
| 4,435,213 | 3/1984 | Hildeman et al. | 75/249 |
| 4,460,541 | 7/1984 | Singleton et al. | 419/42 |

FOREIGN PATENT DOCUMENTS

| | | | |
|---|---|---|---|
| 100470 | 2/1984 | European Pat. Off. | 420/548 |

*Primary Examiner*—Joseph L. Schofer
*Assistant Examiner*—Fred M. Teskin
*Attorney, Agent, or Firm*—Dennison, Meserole, Pollack & Scheiner

[57] ABSTRACT

The invention relates to cylinder liners for internal combustion engines comprising a matrix based on aluminum alloys of high mechanical strength, obtained by powder metallurgy, and methods of producing them. The liners comprise a dispersion of grains of an added intermetallic compound, apart from the dispersion of such intermetallic compounds as may exist in the alloy, the added compound having a melting temperature of over 700° C. The liners are obtained by extruding or sintering a mixture of powders. The liners of the invention may be used particularly in the automobile industry and in any kind of industry where liner-piston units of good compatibility must be obtained from aluminum alloys.

14 Claims, No Drawings

ENGINE CYLINDER LINERS BASED ON ALUMINUM ALLOYS AND INTERMETALLIC COMPOUNDS, AND METHODS OF OBTAINING THEM

BACKGROUND OF THE INVENTION

The present invention relates to cylinder liners for internal combustion engines containing a matrix based on aluminum alloys of high mechanical strength, obtained by powder metallurgy. It also concerns some of the methods of producing these cylinder liners.

Engine cylinder liners on aluminum are not new, but their use has always posed problems of compatibility between their working surface and the engine components, such as pistons, which are in contact with them. Attempts have been made to deal with the difficulties encountered in different ways, such as by providing a steel lining, or by coating the internal wall of the cylinder with harder metals such as iron or chromium, but it has not been possible to completely eliminate the difficulties.

Manufacturers then turned to alloys with better mechanical strength, such as hypereutectic aluminum-silicon alloys. However, the primary silicon crystals which appeared when the liner was molded were found to have an annoying tendency to score the surface of the pistons, due to their relatively large size and angular shape, and the surface of the pistons therefore had to be protected by a coating.

At that stage, since there was still a desire to enjoy some advantages provided by hypereutectic A-S alloys, attempts were made to change the structure of the alloys, particularly with respect of the grains of silicon, to try to give them the necessary compatibility without requiring subsequent surface treatments of the pistons. Among the attempts made the following should be mentioned:

Those methods consisting of changing the casting structure, such as those described in French Pat. No. 1 441 860, where an acid attack is made on the aluminum-matrix so as to bring the silicon grains into relief. The grains are then polished.

Those methods designed to give a new casting structure. This is the case in French Pat. No. 2 235 534, where the liner is molded under cooling conditions so that it does not have any primary silicon phase, but instead has fibrous or spheroidized particles with dimensions of less than 10 $\mu$m.

More recently, in their French Pat. No. 2 343 895, Applicants also turned to a new hypereutectic A-S structure but replaced the casting process with a process of extruding powders obtained by atomization. A method of this type in fact has the advantage of using powders formed at a very high rate of cooling, in which the primary silicon grains are relatively small and in any event, smaller than the size resulting from conventional casting. The size is not affected by the extrusion process and a new structure is thus obtained, with fine, well distributed silicon particles, and this considerably improves the compatibility of the liner with the piston.

However, in the course of tests carried out under particularly severe temperature conditions, the resultant liner is nevertheless found to deteriorate.

After carefully studying this phenomenon, Applicants discovered cause of the low resistance to be local adhesion between the liner and the piston.

They extended their research and reconsidered the criteria for good compatibility, namely:

suitable hardness of the liner material to give it sufficient wear resistance while avoiding the appearance of scores;

a relatively low coefficient of friction to facilitate movement of the components relative to one another; and a tendency of the materials not to stick together, in order to prevent any surface deterioration.

On studying the various prior art solutions, Applicants concluded that, although the hardness function had been achieved fairly well with the primary silicon particles, and although the friction function had been achieved by adding certain lubricants such as graphite, a satisfactory solution to the non-sticking function had not yet been found among the means hitherto used.

For this reason Applicants paid particular attention to the problem of finding an appropriate non-sticking agent.

SUMMARY OF THE INVENTION

Applicants have now succeeded in developing engine liners containing a matrix based on aluminum alloys with high mechanical strength obtained by powder metallurgy, and possibly other elements. The liners are characterized in that they contain a dispersion of grains of at least one added intermetallic compound having a melting point of more than 700° C., said compound being apart from other dispersed intermetallic compounds which may exist as part of the alloy.

DETAILED DESCRIPTION OF THE INVENTION

The present invention comprises a liner of a composite material, in which grains of intermetallic compound, that is to say, of a chemical compound of two or more metals with its own crystalline system, is dispersed in a matrix based on aluminum alloys of high mechanical strength.

It should be emphasized that the dispersion is different from the point of view of structure and/or composition from that which might be present in the matrix of aluminum alloy. It is in fact possible for the aluminum alloy matrix to contain in and of itself some elements which may together form intermetallic compounds while the matrix is being produced by powder metallurgy. However, these compounds form part of the actual structure of the alloy and thus have nothing to do with the compounds of the invention. Applicants have in fact found that the presence of an added compound according to the present invention in the structure of a liner with a matrix of aluminum alloy has the property of greatly reducing, if not eliminating, the tendency of the liner to become welded locally onto the piston when certain temperature limits are exceeded.

Apart from the non-sticking properties tests have been shown that these compounds enable hard points to be formed in the liner, in the manner of grains of silicon. This increases the wear resistance of the liner, so that the presence of primary silicon can be dispensed with.

These compounds have additionally been found to have a good coefficient of friction; they can thus act as a lubricant either by themselves or in association with graphite, in which case they enhance this type of property.

Of the intermetallic compounds studied, $Ni_3Sn$, wherein three nickel atoms are combined with one tin atom to form crystals of the hexagonal type, have been found to perform particularly well in its functions as a "non-sticking" agent, a lubricant and a wear resistant product.

The intermetallic compounds of the present invention are distributed evenly in the mass of the liner in granular form. However, if they are to be fully effective, the grains are preferably calibrated, that is to say, they correspond to the narrowest possible grain size curve, where the dimensions are in any case from 5 to 50 μm. This excludes both excessively fine grains, which lead to seizing of the liner manufacturing equipment, and excessively large grains which cause an increase in the coefficient of friction.

To obtain a favorable compromise between the advantages provided by each constituent of the liner, it has been found that the proportion of grains of intermetallic compound should be from 5 to 15% of the liner mass.

The grains may vary in appearance according to how they are obtained. Thus, one can utilize not only grains prepared by grinding but also grains manufactured by spraying the compound in the liquid state; such grains consequently have a more rounded contour.

As far as the matrix of aluminum alloy is concerned, an alloy of high mechanical strength is used, preferably either of the A—$S_{12}$ type containing elements like copper and magnesium, such as A—$S_{12}$UG where the copper may range from 1 to 5% by weight, or from the 7,000 series such as A—ZGU with 1 to 12% by weight of silicon added to them. Some examples are A—$S_{12}U_4G$ or A—$S_{12}Z_5GU$.

In cases where the lubricating properties of the liner must be improved, the liner structure may include appropriate materials such as graphite in particular, the content of which is then from 3 to 10% by weight.

The present invention also concerns some of the methods of producing the aforementioned liners.

The methods described have a common element, which comprises converting the matrix of high strength aluminum alloy from the liquid state into a powder. This is done by any existing process, such as centrifugal spraying, atomization, etc. The powder is then screened to eliminate particles of dimensions not within the range from 60 to 400 μm, then mixed with grains of intermetallic compound of a grain size from 5 to 50 μm and in a quantity such that they represent from 5 to 15% by weight of the mass of the liner; 3 to 10% by weight of graphite or any other element adapted to improve the lubricating properties may also be added. After appropriate homogenization the mixture is then treated in one of two different ways, either by sintering or by extrusion.

In the case of sintering, the powder mixture is shaped by compressing it in a vertical or isostatic press while cold, and is then sintered in controlled atmosphere. The resulting liner is machined to the appropriate dimensions.

In the case of extrusion, the mixture is compressed while cold in billet form or charged directly into the pot of a press, then extruded in tubular form, possibly after preheating, shielded from the atmosphere.

The extrusion equipment used is well known in the art. It may be either bridge machinery or a flat die/-floating needle unit. The tube thus obtained at the outlet from the press is trimmed and cut to the length of the liners, and these liners are then machined.

It is possible to carry out quenching directly on the tube leaving the die, and then to proceed to a thermal annealing treatment, in order to improve the mechanical properties of the liner produced.

The mixture may also be compressed into the form of blanks which are backward extruded to form cups, the bottom and opposed edge of which are then cut up to obtain liners which are subsequently machined. It is equally possible to carry out direct quenching of the cups after extrusion.

The liners according to the invention may be used particularly in the automobile industry and in any kind of industry where liner-piston units of good compatibility must be obtained from aluminum alloy.

What is claimed is:

1. Engine cylinder liners comprising:

(1) a matrix comprising an aluminum alloy produced by powder metallurgy, said alloy being selected from the group consisting of A—$S_{12}$UG alloys and series 7,000 alloys containing from 1 to 12% by weight added silicon, and (2) a dispersion of grains distributed within said matrix comprising at least one added intermetallic compound having a melting point of more than 700° C., said grains being distinct and not forming part of the actual alloy structure.

2. The liners of claim 1, wherein the intermetallic compound is $Ni_3Sn$.

3. The liners of claim 1, wherein the intermetallic compound is in the form of calibrated grains of dimensions from 5 to 50 μm.

4. The liners of claim 1, wherein the grains of intermetallic compound comprise 5 to 15% of the weight of the liner.

5. The liners of claim 1, wherein the grains of intermetallic compound comprise particles resulting from grinding.

6. The liners of claim 1, wherein the grains of intermetallic compound comprise particles resulting from solidification of an atomized liquid.

7. The liners of claim 1, additionally comprising graphite.

8. The liners of claim 7, wherein the amount of graphite in the liner is from 3 to 10% by weight.

9. In a method of producing engine cylinder liners, comprising:

(1) converting an aluminum alloy from the liquid state to a powder of particle dimensions from 60 to 400 μm;

(2) shaping said powder by cold compression; and (3) sintering said shaped powder in a controlled atmosphere, the improvement comprising mixing the powder prior to shaping with grains of an intermetallic compound having a grain size of 5 to 50 μm and a melting point of more than 700° C., the grains being added in such quantity that they comprise 5 to 15% by weight of the liners.

10. In a method of producing engine cylinder liners, comprising:

(1) converting an aluminum alloy from the liquid state to a powder of particle dimensions from 60 to 400 μm;

(2) shaping by extruding said powder in a press selected from the group consisting of floating needle presses and bridge machinery presses, and;

(3) trimming the extruded product obtained and cutting up said extruded product to the desired length, the improvement comprising mixing the powder prior to shaping with grains of an intermetallic compound having a grain size of 5 to 50 μm and a melting point of more than 700° C., the grains being added in such quantity that they comprise 5 to 15% by weight of the liners.

11. The method of claim 10, wherein the extruded product is quenched on leaving the press, then subjected to a heat treatment, prior to being trimmed and cut up.

12. The method of claim 10, wherein the powder is initially compressed in the form of blanks, then subjected to backward extrusion to form a cup, the bottom and opposed edge of which are cut up to produce a liner which is subsequently machined.

13. The method of claim 12, wherein direct quenching of the cup is carried out after extrusion, prior to being cut up.

14. The method of claim 9, wherein 3 to 10% by weight of graphite powder is added to the mixture.

* * * * *